US007905189B2

(12) United States Patent
Wakazono

(10) Patent No.: US 7,905,189 B2
(45) Date of Patent: Mar. 15, 2011

(54) BOBBIN THREAD WINDER AND SEWING MACHINE EQUIPPED THEREWITH

(75) Inventor: Munehiro Wakazono, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 436 days.

(21) Appl. No.: 12/153,165

(22) Filed: May 14, 2008

(65) Prior Publication Data

US 2009/0050039 A1 Feb. 26, 2009

(30) Foreign Application Priority Data

May 16, 2007 (JP) ..... 2007-130120

(51) Int. Cl.
*D05B 59/00* (2006.01)
*D05B 75/00* (2006.01)

(52) U.S. Cl. ..... 112/279

(58) Field of Classification Search ..... 112/274, 112/279, 302; 242/484.7, 484.8, 487.4
See application file for complete search history.

(56) References Cited

U.S. PATENT DOCUMENTS 1,210,643 A * 1/1917 Hayes ..... 242/487.4
1,848,352 A * 3/1932 Kelso ..... 242/484.8
2,056,829 A * 10/1936 Colegrove et al. ..... 112/279
2,432,138 A * 12/1947 Colegrove ..... 242/484.8
2,836,371 A * 5/1958 Ayres ..... 242/484.8
4,073,250 A * 2/1978 Kasuga ..... 112/274
4,161,153 A * 7/1979 Nawa et al. ..... 112/279
5,816,512 A 10/1998 Nakashima et al.

FOREIGN PATENT DOCUMENTS

| | | |
|---|---|---|
| JP | A-04-132591 | 5/1992 |
| JP | A-09-112568 | 5/1997 |
| JP | A-09-313763 | 12/1997 |
| JP | A-11-257368 | 9/1999 |
| JP | A-2000-045614 | 2/2000 |

* cited by examiner

*Primary Examiner* — Ismael Izaguirre
(74) *Attorney, Agent, or Firm* — Oliff & Berridge, PLC

(57) ABSTRACT

A bobbin thread winder for sewing machine includes a thread winding shaft to which a bobbin is detachably set, a thread winding shaft gear attached to the shaft and having a gear portion, a gear mounted integrally on a timing pulley so as to be mesh-engageable with the gear portion, and a torque limiter mechanism transmitting rotation of the shaft gear to the shaft when load exerted on the shaft is below a predetermined value. The mechanism cuts off transmission of shaft gear rotation so that the shaft gear rotation is prevented from transmission to the shaft when the load is not less than the value. The mechanism includes a closely wound portion on a shaft periphery and a coil spring engaged with the shaft gear. The shaft gear rotation is transmitted to the shaft by frictional force of the closely wound portion when the load is below the value.

8 Claims, 5 Drawing Sheets

BOBBIN THREAD WINDER AND SEWING MACHINE EQUIPPED THEREWITH

CROSS-REFERENCE TO RELATED APPLICATIONS

This application is based on and claims the benefit of priority from the prior Japanese Patent Application No. 2007-130120, filed on May 16, 2007, the entire contents of which are incorporated herein by reference.

BACKGROUND

1. Field

The present disclosure relates to a bobbin thread winder which is provided in a sewing machine arm to be drivingly coupled to a timing pulley driven by a sewing machine motor, thereby winding a thread supplied from a thread supply source on a bobbin, and a sewing machine equipped with the bobbin thread winder.

2. Related Art

Various types of sewing machines such as lock stitch sewing machines include an arm in which a rotary hook is provided. A bobbin on which a bobbin thread is wound is detachably attached to the rotary hook so that a bobbin thread is supplied thereto. When the bobbin thread has been consumed in a sewing operation, the bobbin is detached and a thread of thread spool is wound on the bobbin by a bobbin thread winder provided in an arm of the sewing machine.

For example, Japanese Patent Application Publication, JP-A-H09-313763, discloses a conventional bobbin thread winder which is drivingly coupled to a timing pulley driven by a sewing machine motor, thereby winding a thread supplied from a thread supply source on a bobbin. The above-noted publication corresponds to U.S. Pat. No. 5,816,512. More specifically, the disclosed bobbin thread winder includes a thread winding shaft protruding upward from an upper surface of the arm, a rubber ring provided on a lower end of the thread winding shaft, and a bobbin presser provided near the thread winding shaft.

In winding the bobbin thread, the bobbin which has been emptied is put onto the thread winding shaft, and the distal end of the thread drawn from a thread spool is wound onto the bobbin by a small amount. Thereafter, the thread winding shaft is moved to the bobbin presser side. A spring force of a torsion coil spring presses the rubber ring on the lower end of the thread winding shaft against a side of a timing pulley. When the operator then operates a start/stop switch, torque developed by a sewing machine motor rotates the rubber ring, the thread winding shaft and the bobbin together via a pulley, whereby the thread is wound on the bobbin.

When an amount of thread wound on the bobbin is increased with progress of the bobbin thread winding, an outer periphery of the wound thread is brought into contact with the bobbin presser. The rotation of the bobbin is continued even after contact of the wound thread with the bobbin presser. Accordingly, when an amount of wound thread is further increased, a relative pressing force is exerted on the thread winding shaft by the bobbin presser. As a result, the thread winding shaft is moved away from the bobbin presser against the spring force of the torsion coil spring. Consequently, a contact force between the rubber ring and the pulley is gradually reduced. When a predetermined amount of thread is finally wound on the bobbin, the rubber ring is moved to a location where the rubber ring departs from the side of the pulley. At last, a rotational force of the pulley is not transmitted to the rubber ring such that rotation of the thread winding shaft is stopped.

However, rotation is transmitted by a frictional force between the side of the pulley and the outer periphery of the rubber ring in the above-described conventional bobbin thread winder. Accordingly, since slippage between the side of the pulley and the outer periphery of the rubber ring results in attrition, partial wear of the rubber ring is increased with use for a long period. As a result, rotation of the rubber ring produces rumble and the winding shaft results in irregular rotation. Consequently, there is a possibility that the bobbin thread winding may be disrupted. In this case, a countermeasure such as replacement of the rubber ring needs to be taken.

SUMMARY

Therefore, an object of the present disclosure is to provide a bobbin thread winder which can ensure stability and durability of a bobbin thread winding operation for a long period of time without use of a consumable part such as the rubber ring and a sewing machine equipped with the bobbin thread winder.

The present disclosure provides a bobbin thread winder which is provided in an arm of a sewing machine so as to be supplied with a driving force from a timing pulley to wind a thread supplied from a thread supply onto a bobbin, the bobbin thread winder comprising a thread winding shaft to which the bobbin is detachably set and which is rotated by the timing pulley, the thread winding shaft having an end, a thread winding shaft gear attached to the thread winding shaft and having a first gear portion rotatable relative to the thread winding shaft, a second gear portion provided integrally on the timing pulley so as to be mesh-engageable with the first gear portion of the thread winding shaft, and a torque limiter mechanism transmitting rotation of the thread winding shaft gear to the thread winding shaft when a load exerted on the thread winding shaft is below a predetermined value, the torque limiter mechanism cutting off transmission of rotation of the thread winding shaft gear so that the rotation of the thread winding shaft gear is prevented from being transmitted to the thread winding shaft when the load exerted on the thread winding shaft is not less than the predetermined value, wherein the torque limiter mechanism includes a closely wound portion on a periphery of the thread winding shaft and a coil spring having a spring end engaged with the thread winding shaft gear, the rotation of the thread winding shaft gear is transmitted to the thread winding shaft by a frictional force of the closely wound portion when the load exerted on the thread winding shaft is below the predetermined value, and when the load exerted on the thread winding shaft is not less than the predetermined value, the closely wound portion is loosened such that the rotation transmission is cut off.

In the above-described construction, the thread winding shaft gear in mesh-engagement with the second gear portion of the timing pulley is rotated when the timing pulley is rotated during the winding of a bobbin thread. In this case, when a load exerted on the thread winding shaft is below a predetermined value, rotation of the thread winding shaft is transmitted to the thread winding shaft so that the thread from the thread supply is wound on the bobbin attached to the thread winding shaft. On the other hand, when the load exerted on the thread winding shaft is not less than the predetermined value with progress in the winding of the thread onto the bobbin, the torque limiter mechanism prevents transmission of rotation of the thread winding shaft gear to the thread winding shaft. Consequently, rotation of the thread winding shaft and accordingly rotation of the bobbin are stopped, whereby the bobbin thread winding is stopped.

Rotation is thus transmitted to the thread winding shaft by mesh-engagement of the second gear portion of the timing pulley and the thread winding shaft gear. Accordingly, differing from the case where rotation is transmitted by a frictional force of a rubber ring, the above-described bobbin thread winder can ensure stability and durability of a bobbin thread winding operation for a long period of time without use of a consumable part such as the rubber ring. Moreover, the bobbin thread winding can automatically be completed by the torque limiter mechanism and accordingly, the bobbin thread winding can be prevented from being excessively carried out. Furthermore, the torque limiting mechanism can be realized by a simple construction.

In an embodiment, the thread winding shaft is disposed so as to extend in a direction intersecting a direction of a shaft center of the timing pulley, and each of the first and second gear portions comprises a bevel gear. Consequently, a smooth rotation transmission can be realized.

In further another embodiment, the bobbin thread winder further comprises a bobbin presser provided near the thread winding shaft so as to come into contact with a periphery of the wound thread thereby to increase a rotating torque of the thread winding shaft when a diameter of a thread winding on the bobbin is increased. When an amount of thread wound on the bobbin is at or above a predetermined value, a frictional force between the bobbin and the bobbin presser rapidly increases the torque of thread winding shaft or load, whereupon the torque limiter mechanism can be operated.

Incidentally, the torque limiter mechanism is desirable to operate when an amount of thread wound on the bobbin reaches a range from 70% to 90%, for example. In this case, the rotational load ranges from 130 to 160 gf·cm, for example.

The disclosure also provides a bobbin thread winder which is provided in an arm of a sewing machine so as to be supplied with a driving force from a timing pulley to wind a thread supplied from a thread supply onto a bobbin, the bobbin thread winder comprising a thread winding shaft to which the bobbin is detachably set and which is rotated by the timing pulley, the thread winding shaft having an end, a thread winding shaft gear fixedly provided on the end side of the thread winding shaft and having a first gear portion, a timing pulley gear provided on a side surface of the timing pulley so as to be rotatable relative to the timing pulley, the timing pulley gear having a second gear portion mesh-engageable with the thread winding shaft gear, and a torque limiter mechanism transmitting rotation of the timing pulley to the timing pulley gear when a load exerted on the thread winding shaft is below a predetermined value, the torque limiter mechanism cutting off transmission of rotation of the timing pulley so that the rotation of the timing pulley is prevented from being transmitted to the timing pulley gear when the load exerted on the thread winding shaft is not less than the predetermined value, wherein the torque limiter mechanism includes a cylindrical coil holder formed integrally on the timing pulley and a coil spring having a closely wound portion closely wound on a periphery of the coil holder and an end engaged with the timing pulley gear, the torque limiter mechanism transmits rotation of the timing pulley to the timing pulley gear by a frictional force of the closely wound portion when a load exerted on the thread winding shaft is below a predetermined value, and when the load exerted on the thread winding shaft is not less than the predetermined value, the torque limiter mechanism cuts off transmission of rotation of the timing pulley so that the rotation of the timing pulley is prevented from being transmitted to the timing pulley gear.

In this construction, the thread winding shaft gear in mesh-engagement with the second gear portion of the timing pulley is rotated when the timing pulley is rotated during the winding of a bobbin thread. In this case, when a load exerted on the thread winding shaft is below a predetermined value, rotation of the thread winding shaft is transmitted to the thread winding shaft so that the thread from the thread supply is wound on the bobbin attached to the thread winding shaft. On the other hand, when the load exerted on the thread winding shaft is not less than the predetermined value with progress in the winding of the thread onto the bobbin, the torque limiter mechanism prevents transmission of torque of the timing pulley to the timing pulley gear. Consequently, rotation of the thread winding shaft and accordingly rotation of the bobbin are stopped, whereby the bobbin thread winding is stopped.

Rotation is thus transmitted to the thread winding shaft by mesh-engagement of the first and second gear portions of the thread winding shaft gear and the timing pulley. Accordingly, differing from the case where rotation is transmitted by a frictional force of a rubber ring, the above-described bobbin thread winder can ensure stability and durability of a bobbin thread winding operation for a long period of time without use of a consumable part such as the rubber ring. Moreover, the bobbin thread winding can automatically be completed by the torque limiter mechanism and accordingly, the bobbin thread winding can be prevented from being excessively carried out.

In one embodiment, the thread winding shaft is disposed so as to extend in a direction intersecting a direction of a shaft center of the timing pulley, and each of the first and second gear portions of the thread winding shaft gear and the timing pulley gear respectively comprises a bevel gear. Consequently, a smooth rotation transmission can be realized.

In further another embodiment, the bobbin thread winder further comprises a bobbin presser provided near the thread winding shaft so as to come into contact with a periphery of the wound thread thereby to increase a rotating torque of the thread winding shaft when a diameter of a thread winding on the bobbin is increased. When an amount of thread wound on the bobbin is at or above a predetermined value, a frictional force between the bobbin and the bobbin presser rapidly increases the torque of thread winding shaft or load, whereupon the torque limiter mechanism can be operated.

The disclosure further provides a sewing machine comprising an arm, a sewing machine motor, a timing pulley transmitting torque of the sewing machine motor to a main shaft, a bobbin thread winder which is provided in the arm so as to be supplied with a driving force from the timing pulley to wind a thread supplied from a thread supply onto a bobbin, the bobbin thread winder comprising a thread winding shaft to which the bobbin is detachably set and which is rotated by the timing pulley, the thread winding shaft having an end, a thread winding shaft gear fixedly provided on the end side of the thread winding shaft and having a first gear portion, a timing pulley gear provided on a side surface of the timing pulley so as to be rotatable relative to the timing pulley, the timing pulley gear having a second gear portion mesh-engageable with the thread winding shaft gear, and a torque limiter mechanism transmitting rotation of the timing pulley to the timing pulley gear when a load exerted on the thread winding shaft is below a predetermined value, the torque limiter mechanism cutting off transmission of rotation of the timing pulley so that the rotation of the timing pulley is prevented from being transmitted to the timing pulley gear when the load exerted on the thread winding shaft is not less than the predetermined value, wherein the torque limiter mechanism includes a closely wound portion on a periphery of the thread winding shaft and a coil spring having a spring end engaged with the thread winding shaft gear, the rotation of the thread winding shaft gear is transmitted to the thread winding shaft by a frictional force of the closely wound portion when the load exerted on the thread winding shaft is below the predetermined value, and when the load exerted on the thread winding shaft is not less than the predetermined value, the closely wound portion is loosened such that the rotation transmission is cut off.

BRIEF DESCRIPTION OF THE DRAWINGS

Other objects, features and advantages of the present invention will become clear upon reviewing the following description of one embodiment with reference to the accompanying drawings, in which.

DETAILED DESCRIPTION

Figure 1:
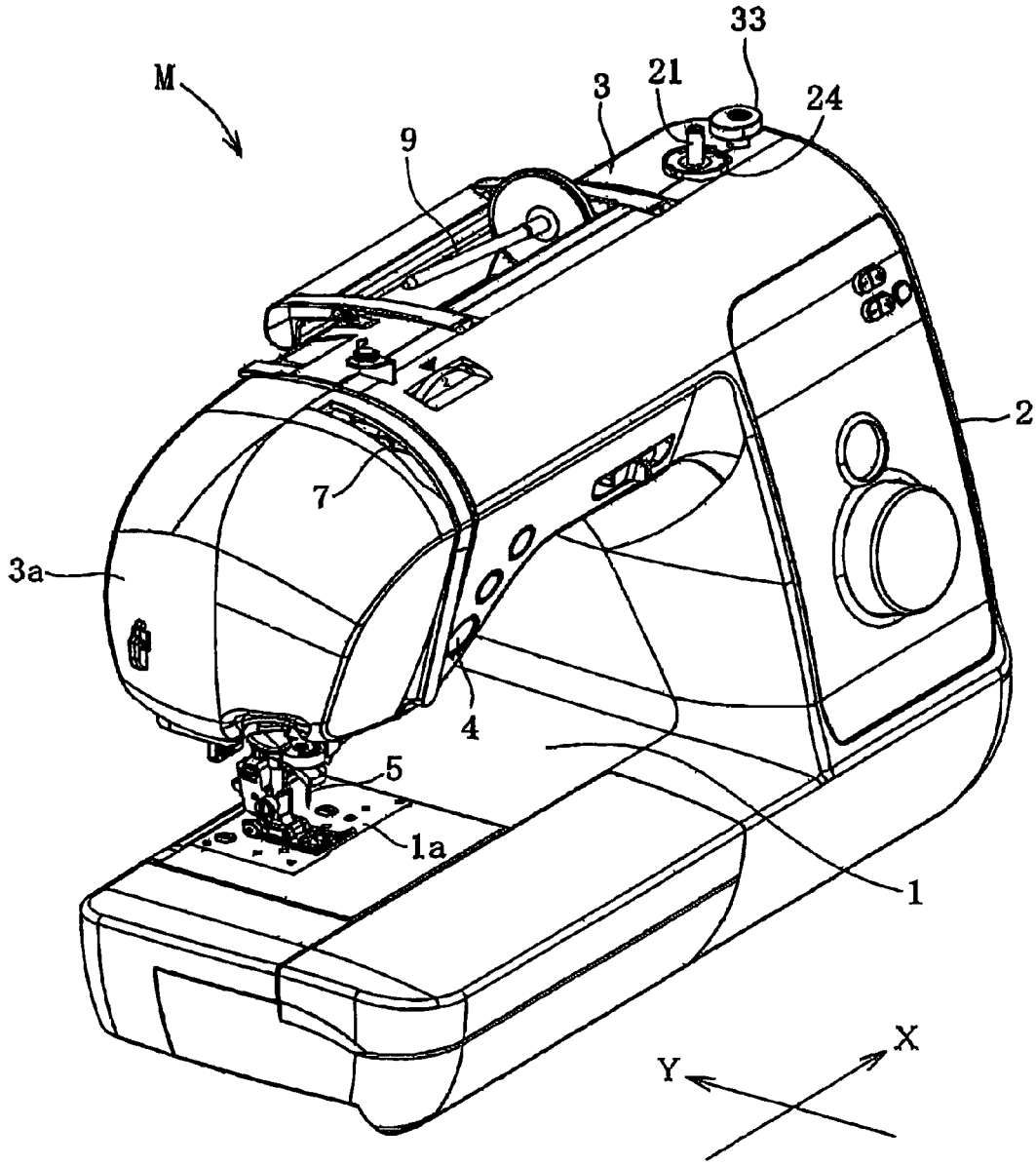
FIG. 1 is a perspective view of a sewing machine of a first illustrative example.
Figure 2:
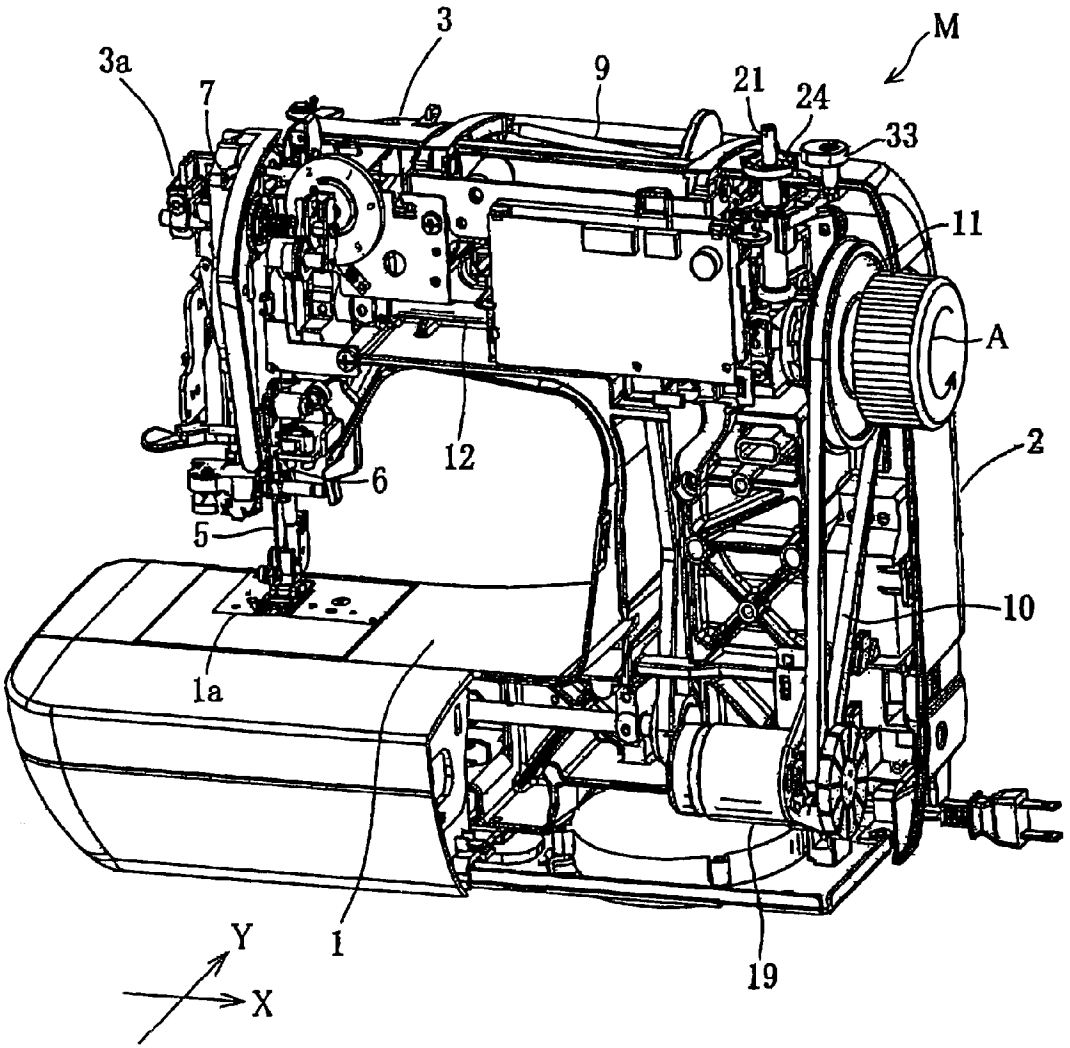
FIG. 2 is a perspective view of the sewing machine as viewed at a different angle from FIG. 1 with a face plate being detached.

A first embodiment in which the invention is applied to a household lock-stitch sewing machine will be described with reference to FIGS. 1 to 5. Referring to FIGS. 1 and 2, an overall construction of the lock-stitch sewing machine M is shown. The sewing machine M includes a body comprising a bed 1 extending in the right and left direction (the X direction), a pillar 2 standing upward from a right end of the bed 1 and an arm 3 extending leftward from an upper end of the pillar 2 all of which are formed integrally. In the following description, the X direction will refer to the right and left direction of the sewing machine M and the Y direction will refer to a front and back direction of the sewing machine M as shown in FIGS. 1 and 2.

Figure 3:
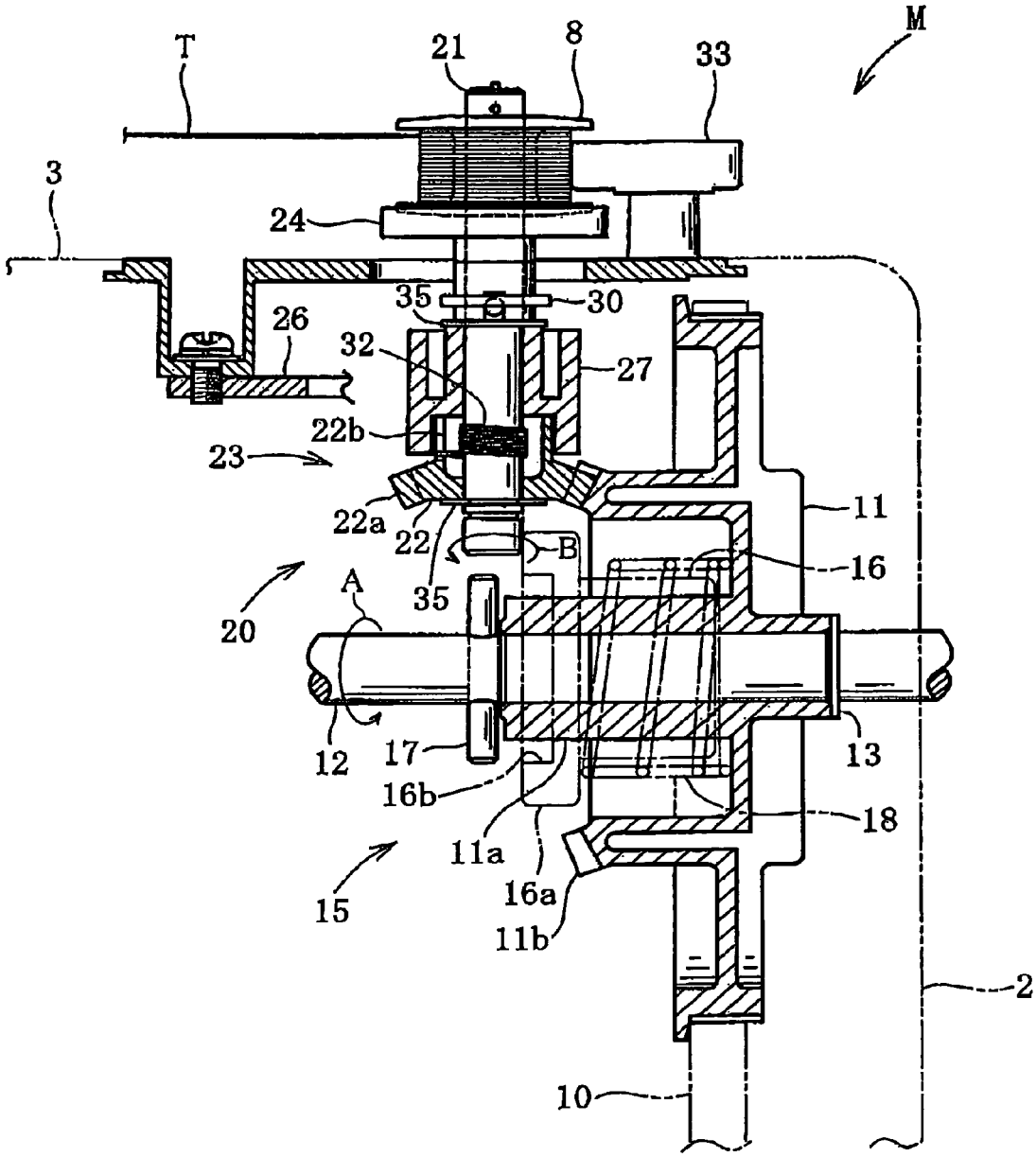
FIG. 3 is a longitudinal front section of the bobbin thread winder.

A main shaft 12 is mounted so as to extend in the right and left direction in the arm 3 as shown in FIGS. 2 and 3. The arm 3 has a distal end or left end on which a head 3*a* is provided. A needle bar 6 having a needle 5 is mounted on the head 3*a*. Furthermore, in the arm 3 are provided a needle bar drive mechanism which converts rotation of the main shaft 12 to vertical movement of the needle bar 6, a needle thread take-up drive mechanism which vertically moves a needle thread take-up 7 (see FIG. 1) in synchronization with the needle bar 6, and the like. Switches are mounted on a front of the arm 3 as shown in FIG. 1. The switches include a start/stop switch 4 for instructing start and stop of a sewing work.

A needle plate 1*a* is mounted on an upper surface of the bed 1 so as to correspond to the needle 5. In the bed 1 are provided a rotary hook which is located below the needle plate 1*a* and forms stitches in cooperation with the needle 5, a feed dog drive mechanism and the like although not shown. A bobbin 8 on which a bobbin thread is wound is detachably attached to the rotary hook. FIG. 3 shows the bobbin 8 while the bobbin thread is wound. A sewing machine motor 19 is mounted on a bottom of the pillar 2 as shown in FIG. 2. A timing pulley 11 is provided in an upper interior of the pillar 2 for rotating the main shaft 12. A timing belt 10 extends between the sewing machine motor 19 and the timing pulley 11. When the start/stop switch 4 is operated for start of the sewing machine M, the sewing machine motor 19 is driven so that the timing pulley 11 is rotated via the timing belt 10. When the start/stop switch 4 is operated for stop of the sewing machine M, the sewing machine motor 19 is stopped.

A driving force of the timing pulley 11 is adapted to be transmitted via a clutch mechanism 15 (see FIG. 3) to the main shaft 12. In this case, the timing pulley 11 is coupled to the main shaft 12 by the clutch mechanism 15 in a normal sewing mode (the state where a thread winding shaft 21 which will be described later assumes a left sewing position) so that the driving force is transmitted to the main shaft 12. As a result, the main shaft 12 is rotated in the direction shown by arrow A in FIG. 3. Furthermore, when the bobbin thread is wound with the thread winding shaft 21 assuming a right bobbin thread winding position, the timing pulley 11 is decoupled from the main shaft 12 so that the thread winding shaft 21 of a bobbin thread winder 20 is rotated.

The clutch mechanism 15 will now be described. The clutch mechanism 15 comprises a clutch member 16 as shown by two-dot chain line in FIG. 3, a transfer pin 17 mounted on the main shaft 12 and a compression coil spring 18 as shown by two-dot chain line in FIG. 3. The aforesaid timing pulley 11 has a cylindrical support 11*a* formed integrally on a central part thereof and fitted on the right end of the main shaft 12 so as to be rotatable relative to the main shaft 12. The timing pulley 11 is positioned by the transfer pin 17 and a retaining ring 13 with respect to the right and left direction as will be described later and supported so as to be immovable in the right and left direction relative to the main shaft 12. The cylindrical support 11*a* has an outer circumference formed with a plurality of axial (horizontal) gear (not shown).

The clutch member 16 is formed into a cylindrical shape and extends in the right and left direction. The clutch member 16 has a left end with a flange 16*a* which is formed integrally with the end and has a large diameter. The clutch member 16 further has an inner circumference formed with a plurality of axial (horizontal) recessed grooves (not shown) corresponding to the gear of the cylindrical support 11*a*. As a result, the recessed grooves of the clutch member 16 are engaged with the gear of the cylindrical support 11*a* such that the clutch member 16 is splined to the cylindrical support 11*a*, whereupon the clutch member 16 is slidable in the direction of shaft center of the main shaft 12.

Figure 5:
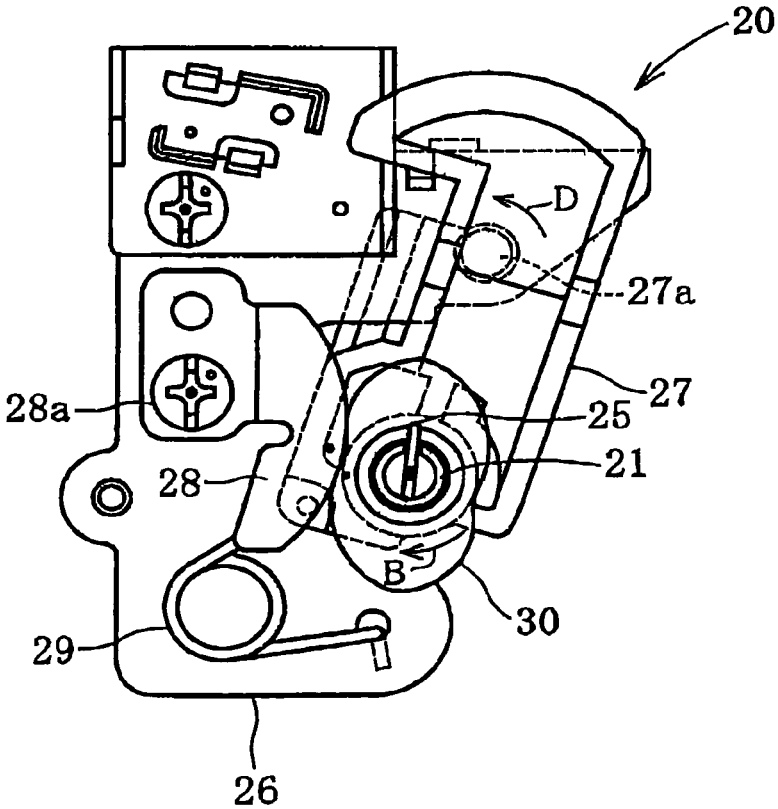
FIG. 5 is also a top view of the bobbin thread winder during sewing.

The transfer pin 17 is secured to the main shaft 12 so as to extend therethrough in order to transfer rotation of the timing pulley 11 via the clutch member 16 to the main shaft 12. On the other hand, the flange 16*a* of the clutch member 16 is formed with a coupling recess 16*b* into which the transfer pin 17 is fitted. The aforesaid compressed coil spring 18 is interposed between the timing pulley 11 and the clutch member 16. The clutch member 16 is normally biased by a spring force of the compressed coil spring 18 leftward or in the direction of engaging the transfer pin 17. In this case, the thread winding shaft 21 is spaced away leftward from the flange 16*a* when located at a left sewing position as shown in FIG. 5, so that the coupling recess 16*b* of the clutch member 16 engages the transfer pin 17. Consequently, the driving force of the timing pulley 11 is transferred to the main shaft 12 so that the main shaft 12 is rotated together with the timing pulley 11.

Figure 4:
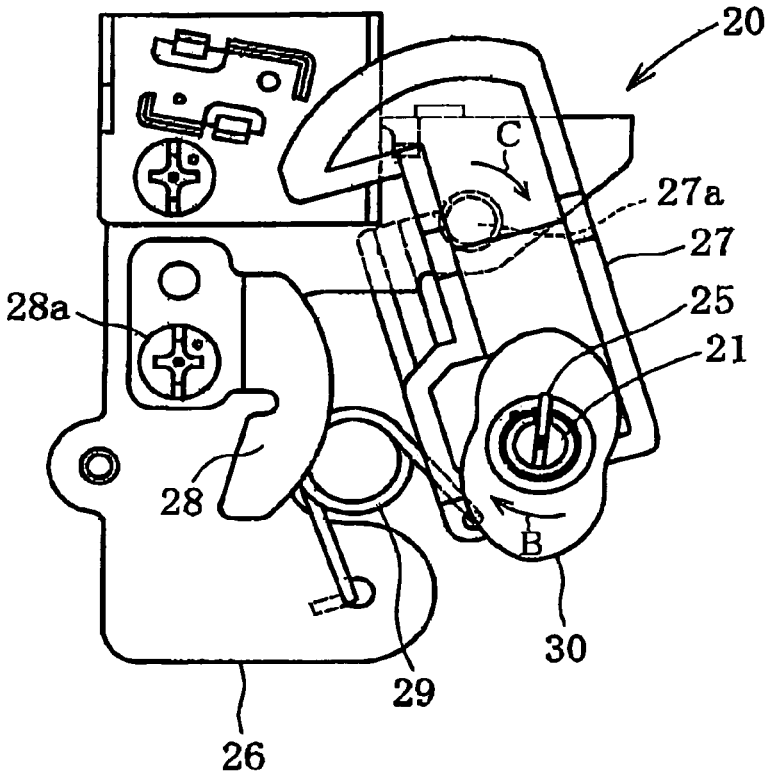
FIG. 4 is a top view of the bobbin thread winder during winding of the bobbin thread.

On the other hand, when the thread winding shaft 21 is manually moved to a right bobbin thread winding position by the operator or user, a lower end of the thread winding shaft 21 presses the flange 16*a* rightward thereby to move the clutch member 16 rightward, as shown in FIGS. 3 and 4. As a result, the clutch member 16 is disengaged from the transfer pin 17.

Thus, the driving force of the timing pulley 11 is not transferred to the main shaft 12 but is transferred to the thread winding shaft 21 via a torque limiter mechanism 23 which will be described later.

The bobbin thread winder 20 is provided on an upper right end of the arm 3 for winding a thread T on the bobbin 8. A thread spool set portion 9 is provided on the upper surface of the arm 3 as shown in FIGS. 1 and 2. A thread spool (not shown) serving as a thread supply source is set on the thread spool set portion 9.

The bobbin thread winder 20 will now be described with reference to FIGS. 3 to 5. The bobbin thread winder 20 comprises the timing pulley 11, the thread winding shaft 21, a thread winding shaft gear 22, the torque limiter mechanism 23, an attachment plate 26, a swing arm 27 and a bobbin presser 33. A ring-shaped gear portion 11*b* comprising a bevel gear is coaxially formed on a left side of the timing pulley 11 so as to be located outside the cylindrical support 11*a* as shown in FIG. 3.

Referring to FIGS. 4 and 5, the attachment plate 26 is formed into an approximately inverted C-shaped plate as viewed on a plane. The attachment plate 26 is fixed to a frame of the arm 3 in a horizontal state as shown in FIG. 3. The swing arm 27 has a central part nearer to the rear thereof, which part is supported on a rear side of the attachment plate 26 so as to be pivotable about a shaft 27*a* in the direction of arrow C or D, as shown in FIGS. 4 and 5. A two-position switching spring 29 extends between a front end side of the attachment plate 26 and a front end of the swing arm 27. The switching spring 29 comprises a toggle spring and is adapted to be switched between a right swing position as shown in FIG. 4 and a left swing position as shown in FIG. 5.

The vertically extending thread winding shaft 21 is rotatably mounted on the front end of the swing arm 27. The thread winding shaft 21 extends in a vertical direction intersecting an axial direction (horizontal direction) of the timing pulley 11 and provided with the thread winding shaft gear 22 mounted on the lower end side of the timing pulley 11 for relative rotation. A pair of retaining rings 35 are fixed to an outer circumference of the thread winding shaft 21 so as to vertically sandwich the swing arm 27 and the thread winding shaft gear 22 therebetween, whereupon the retaining rings 35 are held so as to be axially immovable relative to the swing arm 27. Furthermore, a positioning cam 30 is fixed to an upper part of the upper retaining ring 35 of the thread winding shaft 21.

A cam abutment plate 28 is fixed to an upper surface of the attachment plate 26 by a fixing screw 28*a* so as to correspond to the positioning cam 30 as shown in FIGS. 4 and 5. When the swing arm 27 is located at the left swing position as shown in FIG. 5, the positioning cam 30 abuts against the cam abutment plate 28 such that rotation of the thread winding shaft 21 is stopped. When the swing arm 27 is located at the right swing position as shown in FIG. 4, the thread winding shaft 21 is situated at a bobbin thread winding position. When the swing arm 27 is swung to the left swing position as shown in FIG. 5, the thread winding shaft 21 is situated at a sewing position.

A circular bobbin receiving plate 24 is mounted on a portion of the thread winding shaft 21 near the upper end thereof as shown in FIGS. 1 to 3. The bobbin receiving plate 24 receives the underside of the bobbin 8. FIGS. 4 and 5 show the thread winding shaft 21 with the bobbin receiving plate 24 being detached therefrom. A bobbin holding spring 25 is mounted on the upper end of the thread winding shaft 21 as shown in FIGS. 4 and 5. Accordingly, when the bobbin 8 is attached onto the bobbin receiving plate 24 of the thread winding shaft 21, the bobbin holding spring 25 engages an engagement recess (not shown) provided in the bobbin 8 so that the bobbin 8 is locked so as not to fall off from the thread winding shaft 21 thereby to be rotated together with the shaft.

The thread winding shaft gear 22 has a cylindrical portion 22*c* which is fitted in a cylindrical portion formed in a front-end side underside of the swing arm 27 as shown in FIG. 3. The thread winding shaft gear 22 is attached to the lower end of the thread winding shaft 21 so as to be capable of relative rotation. The thread winding shaft 22 is held by the lower end of the swing arm 27 and the lower retaining ring 35 so as to be axially immovable. The thread winding shaft 22 has a lower end on which a gear portion 22*a* is formed integrally. The gear portion 22*a* comprises an annular bevel gear. As a result, when the thread winding shaft 21 is moved to the right bobbin thread winding position, the gear portion 22*a* of the thread winding shaft gear 22 is adapted to be brought into mesh engagement with the gear portion 11*b* of the timing pulley 11. When the gear portion 22*a* is thus in mesh engagement with the gear portion 11*b*, rotation about the horizontal shaft of the timing pulley 11 in the direction of arrow A is converted to rotation about the vertical shaft of the thread winding shaft gear 22 in the direction of arrow B.

The torque limiter mechanism 23 is provided between the thread winding shaft gear 22 and the thread winding shaft 21. The torque limiter mechanism 23 transfers rotation of the thread winding shaft gear 22 to the thread winding shaft 21 when the load of the thread winding shaft 21 is less than a predetermined value. When the load of the thread winding shaft 21 is no less than the predetermined value, the torque limiter mechanism 23 cuts off rotation of the thread winding shaft gear 22 so that the rotation is not transferred to the thread winding shaft 21.

In the embodiment, the torque limiter mechanism 23 includes a coil spring 32 wound closely on the outer circumference of the thread winding shaft 21 in order that rotary torque may be transmitted from the thread winding shaft gear 22 to the thread winding shaft 21. More specifically, the coil spring 32 is wound on the outer circumference of the thread winding shaft 21 counterclockwise as viewed from the top and is disposed so as to be housed in the cylindrical portion 22*c* of the thread winding shaft gear 22. The coil spring 32 has a lower spring end in engagement with an engagement groove 22*b* formed in the cylindrical portion 22*c*. Furthermore, the coil spring 32 in a free state has an inner diameter of the coil set to be slightly smaller than an outer diameter of the thread winding shaft 21. Accordingly, since the coil spring 32 is attached to the thread winding shaft 21 so as to tighten up the shaft 21, the coil spring 32 rotates the thread winding shaft 21 while receiving a spring loosening force directed so as to loosen the coil spring (the direction in which the inner diameter of the coil spring is enlarged).

When the timing pulley 11 is rotated in the direction of arrow A in FIG. 3 during winding of the bobbin thread, the thread winding shaft gear 22 in mesh engagement with the timing pulley is rotated in the direction of arrow B in FIG. 4 (clockwise as viewed on a plane). When load of the thread winding shaft 21 is smaller than the predetermined value with rotation of the gear 22, rotation of the thread winding shaft gear 22 is transferred via the coil spring 32 to the thread winding shaft 21 so that the thread winding shaft 21 is rotated in the direction of arrow B. As a result, the thread T is drawn from a thread spool set in the thread spool set portion 9 to be wound on the bobbin 8 attached on the thread winding shaft 21. A predetermined amount of thread T is wound on the bobbin 8 in a bobbin thread winding completion state. The predetermined amount of thread T ranges from 70% to 90% of an amount of thread wound on the bobbin 8, for example.

When the bobbin 8 comes to the bobbin thread winding completion state, the periphery of the thread T on the bobbin 8 is brought into contact with the bobbin presser 33. Then, a braking force is applied to the thread winding shaft 21 as the result of frictional resistance between the bobbin presser 33 and the thread T. Consequently, a rotational load of the thread winding shaft 21 is gradually increased. When the rotational load of the thread winding shaft 21 is equal to or larger than a predetermined value (ranging from 130 to 160 gf·cm, for example), the inner diameter of the coil spring 32 is enlarged. As a result, a tightening force of the coil spring 32 against the thread winding shaft 21 is reduced such that the coil spring 32 starts to slip on the thread winding shaft 21 and finally runs idle. Consequently, rotation of the thread winding shaft gear 22 is no longer transmitted to the thread winding shaft 21.

The bobbin thread winder 20 constructed as described above will operates as follows. When the bobbin thread of the bobbin 8 has been used up, the operator detaches the bobbin 8 from a rotary hook (not shown) and attaches the bobbin 8 to the thread winding shaft 21 while the sewing machine M (sewing machine motor 19) is in a stopped state. With this, the operator sets a thread spool in the thread spool set portion 9, drawing out the distal end of the thread T from the thread spool to be wound on the bobbin 8 several turns. The thread winding shaft 21 is manually moved to the right bobbin thread winding position (see FIG. 4). In this case, the swing arm 27 is moved from the left swing position (see FIG. 5) to the right swing position as shown in FIG. 4, and the thread winding shaft 21 is displaced to the right bobbin thread winding position. Accordingly, the thread winding shaft gear 22 is brought into mesh engagement with the gear portion 11*b* of the timing pulley 11, whereas the clutch member 16 is moved rightward thereby to be disengaged from the transfer pin 17.

When the operator turns on the start/stop switch under the above-described condition, the sewing machine motor 19 is driven so that the timing pulley 11 is rotated via the timing pulley 11 in the direction of arrow A in FIG. 3 and the thread winding shaft gear 22 in mesh engagement with the timing pulley 11 is rotated in the direction of arrow B in FIGS. 3 and 4. In this case, when winding of the bobbin thread starts, an amount of thread T wound on the bobbin 8 is small and the rotational load of the thread winding shaft 21 is accordingly small. As a result, the rotation of the thread winding shaft 21 is transmitted via the coil spring 32 to the thread winding shaft 21 such that the thread winding shaft 21 is rotated, whereupon the thread T is kept wound onto the bobbin 8.

Subsequently, when the bobbin 8 comes near to the bobbin thread winding completion state, the braking force is applied to the thread winding shaft 21 as the result of frictional resistance between the bobbin presser 33 and the thread T, whereupon the rotational load of the thread winding shaft 21 is gradually increased. When the rotational load of the thread winding shaft 21 becomes equal to or larger than the predetermined value (ranging from 130 to 160 gf·cm, for example), the inner diameter of the coil spring 32 is enlarged. As a result, a tightening force of the coil spring 32 against the thread winding shaft 21 is reduced such that the coil spring 32 starts to slip on the thread winding shaft 21 and finally runs idle. Consequently, when the predetermined amount of thread T has been wound on the bobbin 8, transmission of rotation of the thread winding shaft gear 22 is cut off by the coil spring 32 (the torque limiter mechanism 23) so that the rotation of the thread winding shaft gear 22 is prevented from being transmitted to the thread winding shaft 21. The operator turns off the start/stop switch 4 when confirming that rotation of the thread winding shaft 21 (the bobbin 8) has been stopped such that winding of the bobbin thread has been completed. Subsequently, the bobbin 8 on which the thread T has been wound is detached from the thread winding shaft 21, and the thread winding shaft 21 is moved from the bobbin thread winding position to the leftward sewing position. As a result, the swing arm 27 is switched to the left swing position as shown in FIG. 5 such that the thread winding shaft gear 22 is released from the mesh engagement with the gear portion 11*b*. Furthermore, the clutch member 16 is displaced to the left so that the timing pulley 11 and the main shaft 12 are coupled together, whereby the sewing operation is allowed.

According to the bobbin thread winder 20 of the embodiment, rotation is transmitted to the thread winding shaft 21 by the mesh engagement of the gear portion 11*b* of the timing pulley 11 and the gear portion 22*a* of the thread winding shaft gear 22. Accordingly, differing from the conventional construction in which rotation is transmitted by the frictional force of a rubber ring, the above-described bobbin thread winder 20 excludes a wear-out part such as the rubber ring. Consequently, the stability and durability of the bobbin thread winding operation can be ensured for a long period of time. In this case, since each of gear portion 11*b* of the timing pulley 11 and the gear portion 22*a* of the thread winding shaft gear 22 comprises the bevel gear, smooth rotation transmission can be realized even when the axes of the timing pulley 11 and the thread winding shaft gear 22 are at right angles to each other. Moreover, the bobbin thread winding operation is automatically completed by the torque limiter mechanism 23, the bobbin thread winding operation can be prevented from being executed excessively. Since the torque limiter mechanism 23 comprises the coil spring 32 particularly in the foregoing embodiment, the torque limiter mechanism 23 can be formed into a simple construction at lower costs. Furthermore, the bobbin presser 33 is provided so as to be brought into contact with the outer periphery of the wound thread T, thereby increasing the rotational torque. Consequently, when the bobbin thread winding completion state comes near, the rotational torque or the load of the thread winding shaft 21 is quickly increased such that the torque limiter mechanism 23 can quickly be operated advantageously.

The bobbin thread winder 20A of a second embodiment will be described with reference to FIG. 6. In the second embodiment, identical or similar parts are labeled by the same reference symbols as those in the first embodiment, and only the difference of the second embodiment from the first embodiment will be described. In the bobbin thread winder 20A of the second embodiment, the rotational force of the timing pulley 11A is transmitted via the coil spring 34 serving as the torque limiter mechanism 23A to the timing pulley gear 14. The thread winding shaft gear 22A and the thread winding shaft 21 are driven by rotation of the timing pulley gear 14.

The clutch mechanism 15A is provided on the timing pulley 11A. The rotational force of the timing pulley 11A rotated by the sewing machine motor 19 is transmitted to the main shaft 12 during sewing. On the other hand, the timing pulley 11A is decoupled from the main shaft 12 during the bobbin thread winding and the thread winding shaft 21 is rotated. The clutch mechanism 15A comprises a coupling pulley 11B coupled to the left side of the timing pulley 11A, the clutch member 16A is splined to the coupling pulley 11B, and the transfer pin 17 provided on the main shaft 12. The coupling pulley 11B is formed into a cylindrical shape and is rotatably fitted with the main shaft 12. The coupling pulley 11B has an arc protrusion 11*d* formed integrally therewith so as to protrude rightward from the right end surface. On the other hand, an arc recess 11*e* is formed in a right side of the timing pulley 11A. The protrusion 11*d* of the coupling pulley 11B is engaged with the arc recess 11*e* so that the coupling pulley 11B is rotatable together with the timing pulley 11A. The timing pulley 11A and the coupling pulley 11B coupled to the timing pulley 11A are positioned in the right and left direction by the transfer pin 17 and supported so as to be immovable in the right and left direction relative to the main shaft 12.

The coupling pulley 11B has an outer circumference formed with a plurality of axially extending gear (not shown). The clutch member 16A has an inner circumference formed with a plurality of axially extending recessed grooves (not shown) and Corresponding to the gear of the coupling pulley 11B. The gear of the coupling pulley 11B are splined to the recessed grooves of the clutch member 16A so that the clutch member 16A is slidable in the direction of the shaft center of the main shaft 12. Furthermore, the transfer pin 17 is secured to the main shaft 12 so as to extend through the main shaft 12. The flange 16*a* of the left end of the clutch member 16A is formed with a coupling recess 16*b* into which the transfer pin 17 is fitted. The clutch member 16A is normally biased by the spring force of the compression coil spring 18 leftward or in such a direction that the clutch member 16A engages the transfer pin 17. The compression coil spring 18 is interposed between the coupling pulley 11B and the clutch member 16A.

The transfer pin 17 engages the coupling recess 16*b* of the clutch member 16A since the swing arm 27 is located at the swing position (see FIG. 5) and the thread winding shaft 21 is located at the left sewing position during sewing. Accordingly, the rotational force of the sewing machine motor 19 is transmitted via the timing belt 10 to the timing pulley 11A and the coupling pulley 11B. The rotational force of the sewing machine motor 19 is further transmitted via engagement of the clutch member 16*a* and the transfer pin 17 to the main shaft 12.

On the other hand, when the thread T is wound on the bobbin 8, the swing arm 27 is swung to the right swing position (see FIG. 4) so that the thread winding shaft 21 is moved to the bobbin thread winding position. The lower end of the thread winding shaft 21 presses the flange 16*a* rightward so that the clutch member 16A is moved rightward. As a result, the clutch member 16A and the transfer pin 17 are released from engagement, whereby the rotational force of the timing pulley 11A is not transmitted to the main shaft 12. Consequently, the main shaft 12 is stopped. Under this condition, the rotational force of the timing pulley 11A is transmitted via the torque limiter mechanism 23A to the timing pulley gear 14 and the thread winding shaft gear 22, so that the thread winding shaft 21 is rotated.

The bobbin thread winder 20A of the second embodiment comprises the timing pulley 11A, the timing pulley gear 14, the thread winding shaft 21, the thread winding shaft gear 22A secured to the lower end of the thread winding shaft 21, the torque limiter mechanism 23A, the attachment plate 26 and the swing arm 27. On the attachment plate 27 are provided the swing arm 27, the cam abutment plate 28, the two-position switching spring 29, the thread winding shaft 21, and the thread winding shaft gear 22A. The thread winding shaft gear 22A has a cylindrical portion 22*c* which is fitted in a cylindrical portion formed in a front-end side underside of the swing arm 27. The thread winding shaft 22A has a lower end on which the gear portion 22*a* is formed integrally. The gear portion 22*a* comprises an annular bevel gear. The thread winding shaft gear 22A is secured to the lower end of the thread winding shaft 21.

On the other hand, a cylindrical coil receiving portion 11*c* formed integrally on the left side of the timing pulley 11A. The coil receiving portion 11*c* is located at the outer circumferential side relative to the coupling pulley 11B so as to be coaxial with the coupling pulley 11B. A timing pulley gear 14 is provided on the left side of the timing pulley 11A. The timing pulley gear 14 is generally formed into a cylindrical shape as a whole and has a cylindrical portion 14*a* rotatably fitted in the inner circumference of the coil receiving portion 11*c*, an annular engagement portion 14*b* extending from a right end of the cylindrical portion 14*a* toward the inner circumference of the coil receiving portion 11*c*, a bent portion 14*c* bent to the side of an outer circumference, and a gear portion 14*d* formed on the left outer circumference of the bent portion 14*c* and comprising an annular bevel gear. These portions 14*a* to 14*d* are formed integrally.

The annular engagement portion 14*b* is held between the timing pulley 11A and the coupling portion, whereupon the timing pulley gear 14 is supported on the timing pulley 11A so as to be axially immovable and rotatable relative to the timing pulley 11A. The gear portion 22*a* of the thread winding shaft gear 22A is adapted to be brought into mesh engagement with the annular gear formed on the left end side of the timing pulley gear 14 when the thread winding shaft 21 is moved to the right bobbin thread winding position.

The torque limiter mechanism 23A is provided between the timing pulley 11A and the timing pulley gear 14. The torque limiter mechanism 23A comprises a coil spring 34 closely wound on the outer circumference of the coil receiving portion 11*c*. The coil spring 34 is wound on the outer circumference of the coil receiving portion 11*c* counterclockwise as viewed from the right (the same direction as a rotational direction of the timing pulley 11A). A left spring end of the coil spring 34 is in engagement with an engagement groove 14*c* of timing pulley gear 14. Furthermore, the coil spring 34 in a free state has an inner diameter of the coil set to be slightly smaller than an outer diameter of the coil receiving portion 11*c*. In this case, too, since the coil spring 34 is attached to the thread winding shaft 21 so as to tighten up the coil receiving portion 11*c*, the coil spring 34 rotates the timing pulley gear 14 while receiving a spring loosening force directed so as to loosen the coil spring (the direction in which the inner diameter of the coil spring is enlarged). When load of the thread winding shaft 21 is smaller than the predetermined value, rotation of the timing pulley 11A is transmitted via the timing pulley gear 14 and the thread winding shaft gear 22A to the thread winding shaft 21, so that the thread winding shaft 21 is rotated in the direction of arrow B in FIG. 6. Thus, the bobbin thread winding operation is carried out.

On the other hand, the frictional resistance between the bobbin presser 33 and the thread T in the bobbin thread winding complete state in which a predetermined amount of thread T is wound on the bobbin 8. The rotational load of the thread winding shaft 21 is gradually increased by the frictional resistance between the bobbin presser 33 and the thread T. When the rotational load of the thread winding shaft 21 is equal to or larger than a predetermined value (ranging from 130 to 160 gf·cm, for example), the inner diameter of the coil spring 34 is enlarged. As a result, the coil spring 34 starts to slip on the coil receiving portion 11*c*, finally running idle. Consequently, rotation of the timing pulley 11*a* is no longer transmitted to the thread winding shaft 21.

According to the bobbin thread winder 20A thus constructed, the gear 22*a* of the thread winding shaft gear 22A and the gear 14*b* of the timing pulley gear 14 are brought into mesh engagement with each other when the operator attaches the bobbin 8 to the thread winding shaft 21, winds the distal end of the thread T from the thread spool on the bobbin 8 and moves the thread winding shaft 21 to the bobbin thread winding position, in the same manner as in the first embodiment. Consequently, the clutch member 16A and the transfer pin 17 are released from the engagement.

Figure 6:
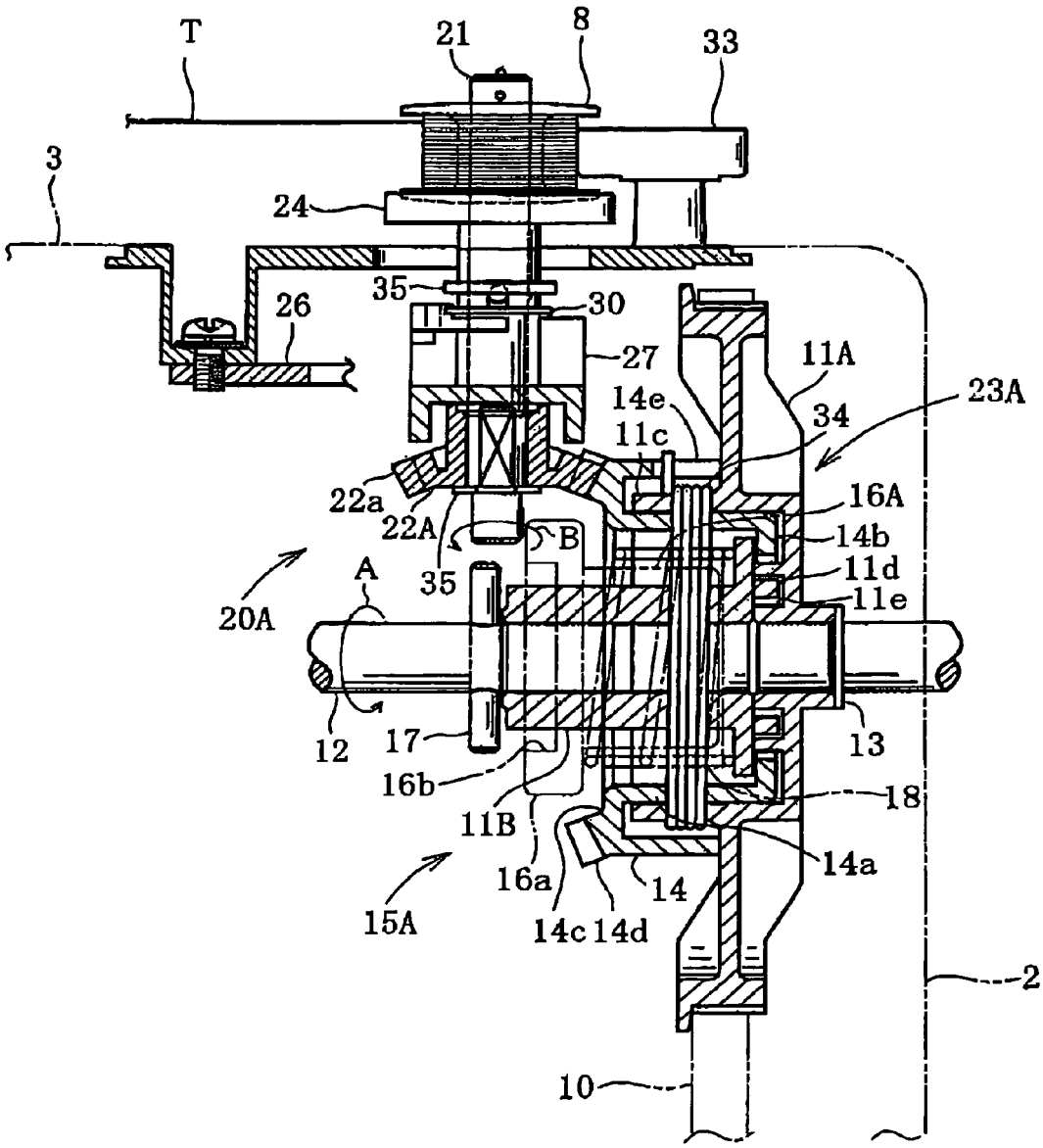
FIG. 6 is a perspective view of a sewing machine of a second illustrative example.

When the operator turns on the start/stop switch under the above-described condition, the sewing machine motor 19 is driven so that the timing pulley 11A is rotated via the timing pulley 11 in the direction of arrow A in FIG. 6. Since the rotational load of the thread winding shaft 21 is small in the initial stage of bobbin thread winding, the rotation of the timing pulley 11A is transmitted via the coil spring 34 to the timing pulley gear 14. As a result, the thread winding shaft 21 is rotated via the thread winding shaft gear 22A so that the thread T is wound on the bobbin 8. Thereafter, when the rotational load of the thread winding shaft 21 is equal to or larger than a predetermined value (ranging from 130 to 160 gf·cm, for example), the inner diameter of the coil spring 34 biased in the direction of loosening the spring is enlarged. As a result, the coil spring 34 starts to slip on the thread winding shaft 21 and finally runs idle. Consequently, when the predetermined amount of thread T has been wound on the bobbin 8, the rotational force of the timing pulley 11A is cut off by the coil spring 34 (the torque limiter mechanism 23A) so that the rotational force is prevented from being transmitted to the thread winding shaft 21. The operator turns off the start/stop switch 4 when confirming that rotation of the thread winding shaft 21 (the bobbin 8) has been stopped such that winding of the bobbin thread has been completed. The thread winding shaft 21 is then moved from the bobbin thread winding position to the left sewing position. The thread winding shaft gear 22A and the timing pulley gear 14 are then released form the mesh engagement, and the clutch member 16A is moved leftward so that the timing pulley 11A and the main shaft 12 are coupled together, whereby the sewing operation is allowed.

According to the bobbin thread winder 20A of the second embodiment, too, rotation is transmitted to the thread winding shaft 21 by the mesh engagement of the gear portion 14*d* of the timing pulley gear 14 and the gear portion 22*a* of the thread winding shaft gear 22A as in the first embodiment. Accordingly, differing from the conventional construction in which rotation is transmitted by the frictional force of a rubber ring, the above-described bobbin thread winder 20A excludes a wear-out part such as the rubber ring. Consequently, the stability and durability of the bobbin thread winding operation can be ensured for a long period of time. In this case, since each of gear portions 14*d* and 22*a* of the timing pulley gear 14 and the thread winding shaft gear 22A comprises the bevel gear, smooth rotation transmission can be realized even when the axes of the timing pulley 11A and the thread winding shaft gear 22A are at right angles to each other. Moreover, the bobbin thread winding operation is automatically completed by the torque limiter mechanism 23A, the bobbin thread winding operation can be prevented from being executed excessively. Since the torque limiter mechanism 23A comprises the coil spring 34 particularly in the foregoing embodiment, the torque limiter mechanism 23A can be formed into a simple construction at lower costs. Furthermore, the bobbin presser 33 is provided so as to be brought into contact with the outer periphery of the wound thread T, thereby increasing the rotational torque. Consequently, when the bobbin thread winding completion state comes near, the rotational torque or the load of the thread winding shaft 21 is quickly increased such that the torque limiter mechanism 23A can quickly be operated advantageously.

Several modified forms of the foregoing embodiments will be described. Although the bobbin presser 33 is provided in each foregoing embodiment, the bobbin presser 33 may be eliminated. In this case, tension of the thread T supplied from the thread spool increases the rotational moment as a winding diameter of the thread T wound on the bobbin 8 is increased. This means that the rotational load of the thread winding shaft 21 is increased according to the winding diameter of the thread T wound on the bobbin B. Accordingly, the torque limiter mechanism can be configured so as to operate when an amount of thread wound on the bobbin reaches a range from 70% to 90%, for example.

Regarding the coil springs 32 and 34 of the torque limiter mechanisms 23 and 23A, a spring wire diameter, an inner diameter of coil and a spring constant are set in view of various thread winding conditions including rotational speeds of thread winding shaft gears 22 and 22A during thread winding, the magnitude of rotational load of the thread winding shaft 21 at the time of completion of bobbin thread winding and the like. Various types of springs can be employed.

The foregoing second embodiment describes shapes and the coupling relationship of the timing pulley 11A and the timing pulley gear 14 and the location of the coil spring 34. However, these are mere examples and can be changed according to use conditions.

Although the invention is applied to the household lockstitch sewing machine M in each foregoing embodiment, the invention may be applied to various types of sewing machines.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A bobbin thread winder which is provided in an arm of a sewing machine so as to be supplied with a driving force from a timing pulley to wind a thread supplied from a thread supply onto a bobbin, the bobbin thread winder comprising:

a thread winding shaft to which the bobbin is detachably set and which is rotated by the timing pulley, the thread winding shaft having an end;

a thread winding shaft gear attached to the thread winding shaft and having a first gear portion rotatable relative to the thread winding shaft;

a second gear portion provided integrally on the timing pulley so as to be mesh-engageable with the first gear portion of the thread winding shaft; and a torque limiter mechanism transmitting rotation of the thread winding shaft gear to the thread winding shaft when a load exerted on the thread winding shaft is below a predetermined value, the torque limiter mechanism cutting off transmission of rotation of the thread winding shaft gear so that the rotation of the thread winding shaft gear is prevented from being transmitted to the thread winding shaft when the load exerted on the thread winding shaft is not less than the predetermined value, wherein:

the torque limiter mechanism includes a closely wound portion on a periphery of the thread winding shaft and a coil spring having a spring end engaged with the thread winding shaft gear;

the rotation of the thread winding shaft gear is transmitted to the thread winding shaft by a frictional force of the closely wound portion when the load exerted on the thread winding shaft is below the predetermined value; and when the load exerted on the thread winding shaft is not less than the predetermined value, the closely wound portion is loosened such that the rotation transmission is cut off.

2. The bobbin thread winder according to claim 1, wherein the thread winding shaft is disposed so as to extend in a direction intersecting a direction of a shaft center of the timing pulley, and each of the first and second gear portions comprises a bevel gear.

3. The bobbin thread winder according to claim 1, further comprising a bobbin presser provided near the thread winding shaft so as to come into contact with a periphery of the wound thread thereby to increase a rotating torque of the thread winding shaft when a diameter of a thread winding on the bobbin is increased.

4. A bobbin thread winder which is provided in an arm of a sewing machine so as to be supplied with a driving force from a timing pulley to wind a thread supplied from a thread supply onto a bobbin, the bobbin thread winder comprising:

a thread winding shaft to which the bobbin is detachably set and which is rotated by the timing pulley, the thread winding shaft having an end;

a thread winding shaft gear fixedly provided on the end side of the thread winding shaft and having a first gear portion;

a timing pulley gear provided on a side surface of the timing pulley so as to be rotatable relative to the timing pulley, the timing pulley gear having a second gear portion mesh-engageable with the thread winding shaft gear; and a torque limiter mechanism transmitting rotation of the timing pulley to the timing pulley gear when a load exerted on the thread winding shaft is below a predetermined value, the torque limiter mechanism cutting off transmission of rotation of the timing pulley so that the rotation of the timing pulley is prevented from being transmitted to the timing pulley gear when the load exerted on the thread winding shaft is not less than the predetermined value, wherein:

the torque limiter mechanism includes a cylindrical coil holder formed integrally on the timing pulley and a coil spring having a closely wound portion closely wound on a periphery of the coil holder and an end engaged with the timing pulley gear;

the torque limiter mechanism transmits rotation of the timing pulley to the timing pulley gear by a frictional force of the closely wound portion when a load exerted on the thread winding shaft is below a predetermined value; and when the load exerted on the thread winding shaft is not less than the predetermined value, the torque limiter mechanism cuts off transmission of rotation of the timing pulley so that the rotation of the timing pulley is prevented from being transmitted to the timing pulley gear.

5. The bobbin thread winder according to claim 4, wherein the thread winding shaft is disposed so as to extend in a direction intersecting a direction of a shaft center of the timing pulley, and each of the first and second gear portions of the thread winding shaft gear and the timing pulley gear respectively comprises a bevel gear.

6. The bobbin thread winder according to claim 4, further comprising a bobbin presser provided near the thread winding shaft so as to come into contact with a periphery of the wound thread thereby to increase a rotating torque of the thread winding shaft when a diameter of a thread winding on the bobbin is increased.

7. A sewing machine comprising:

an arm;

a sewing machine motor;

a timing pulley transmitting torque of the sewing machine motor to a main shaft;

a bobbin thread winder which is provided in the arm so as to be supplied with a driving force from the timing pulley to wind a thread supplied from a thread supply onto a bobbin, the bobbin thread winder comprising:

a thread winding shaft to which the bobbin is detachably set and which is rotated by the timing pulley, the thread winding shaft having an end;

a thread winding shaft gear attached to the thread winding shaft and having a first gear portion rotatable relative to the thread winding shaft;

a second gear portion provided integrally on the timing pulley so as to be mesh-engageable with the first gear portion of the thread winding shaft; and a torque limiter mechanism transmitting rotation of the thread winding shaft gear to the thread winding shaft when a load exerted on the thread winding shaft is below a predetermined value, the torque limiter mechanism cutting off transmission of rotation of the thread winding shaft gear so that the rotation of the thread winding shaft gear is prevented from being transmitted to the thread winding shaft when the load exerted on the thread winding shaft is not less than the predetermined value, wherein:

the torque limiter mechanism includes a closely wound portion on a periphery of the thread winding shaft and a coil spring having a spring end engaged with the thread winding shaft gear;

the rotation of the thread winding shaft gear is transmitted to the thread winding shaft by a frictional force of the closely wound portion when the load exerted on the thread winding shaft is below the predetermined value; and when the load exerted on the thread winding shaft is not less than the predetermined value, the closely wound portion is loosened such that the rotation transmission is cut off.

8. A sewing machine comprising:

an arm;

a sewing machine motor;

a timing pulley transmitting torque of the sewing machine motor to a main shaft;

a bobbin thread winder which is provided in the arm so as to be supplied with a driving force from the timing pulley to wind a thread supplied from a thread supply onto a bobbin, the bobbin thread winder comprising:

a thread winding shaft to which the bobbin is detachably set and which is rotated by the timing pulley, the thread winding shaft having an end;

a thread winding shaft gear fixedly provided on the end side of the thread winding shaft and having a first gear portion;

a timing pulley gear provided on a side surface of the timing pulley so as to be rotatable relative to the timing pulley, the timing pulley gear having a second gear portion mesh-engageable with the thread winding shaft gear; and a torque limiter mechanism transmitting rotation of the timing pulley to the timing pulley gear when a load exerted on the thread winding shaft is below a predetermined value, the torque limiter mechanism cutting off transmission of rotation of the timing pulley so that the rotation of the timing pulley is prevented from being transmitted to the timing pulley gear when the load exerted on the thread winding shaft is not less than the predetermined value, wherein:

the torque limiter mechanism includes a cylindrical coil holder formed integrally on the timing pulley and a coil spring having a closely wound portion closely wound on a periphery of the coil holder and an end engaged with the timing pulley gear;

the torque limiter mechanism transmits rotation of the timing pulley to the timing pulley gear by a frictional force of the closely wound portion when a load exerted on the thread winding shaft is below a predetermined value; and when the load exerted on the thread winding shaft is not less than the predetermined value, the torque limiter mechanism cuts off transmission of rotation of the timing pulley so that the rotation of the timing pulley is prevented from being transmitted to the timing pulley gear.

* * * * *